US006394167B1

(12) United States Patent
Cohen-Ravid et al.

(10) Patent No.: US 6,394,167 B1
(45) Date of Patent: May 28, 2002

(54) SECURITY BAR ASSEMBLY

(76) Inventors: Moshe Cohen-Ravid, 202 - 2270 West 5th Avenue, Vanouver, British Columbia (CA), V6K 1S3; John Alexander Lane, 3755 West Broadway, Vancouver, British Columbia (CA), V6K 2B9

( * ) Notice: Subject to any disclaimer, the term of this patent is extended or adjusted under 35 U.S.C. 154(b) by 0 days.

(21) Appl. No.: 09/524,089

(22) Filed: Mar. 13, 2000

Related U.S. Application Data

(63) Continuation-in-part of application No. 08/820,847, filed on Mar. 20, 1997, now Pat. No. 6,035,917.

(51) Int. Cl.[7] ..... E04F 10/08
(52) U.S. Cl. ..... 160/32; 160/188
(58) Field of Search ..... 160/32, 33, 35, 160/36, 37, 133, 188, 189, 201, 405

(56) References Cited

U.S. PATENT DOCUMENTS

| | | | | |
|---|---|---|---|---|
| 343,956 A | | 6/1886 | Holmes | |
| 813,631 A | | 2/1906 | Elmquist | |
| 1,597,392 A | | 8/1926 | Rorabeck | |
| 2,057,850 A | | 10/1936 | Sims | 186/60 |
| 2,095,690 A | | 10/1937 | Brunst | 189/56 |
| 2,423,987 A | | 7/1947 | Levikow | 160/35 |
| 2,672,192 A | | 3/1954 | Goldner | 160/32 |
| 2,882,045 A | | 4/1959 | Moore | 268/59 |
| 3,103,246 A | | 9/1963 | Brodsky | 160/188 |
| 3,289,350 A | | 12/1966 | Moody | 49/28 |
| 3,389,740 A | | 6/1968 | Buehler | 160/188 |
| 3,601,175 A | | 8/1971 | Wardlaw | 160/133 |
| 3,738,413 A | | 6/1973 | Frobosilo et al. | 160/35 |
| 3,739,832 A | | 6/1973 | Sivin | 160/133 |
| 3,842,891 A | | 10/1974 | Kinnroth et al. | 160/35 |
| 3,850,465 A | | 11/1974 | Hill et al. | 292/231 |
| 3,955,661 A | | 5/1976 | Popper et al. | 192/150 |
| 4,139,042 A | * | 2/1979 | Watanabe et al. | 160/36 |
| 4,282,920 A | | 8/1981 | Kremm | 160/133 |
| 4,662,420 A | * | 5/1987 | Hirao | 160/32 |
| 4,838,331 A | * | 6/1989 | Kasai | 160/36 |
| 4,953,608 A | | 9/1990 | Larsson | 160/1 |
| 5,044,417 A | | 9/1991 | Bresson | 160/310 |
| 5,065,806 A | * | 11/1991 | Kondoh | 160/36 |
| 5,139,075 A | | 8/1992 | Desrochers | 160/310 |
| 5,172,742 A | * | 12/1992 | Iwasaki et al. | 160/36 |
| 5,211,440 A | | 5/1993 | Cramaro | 296/98 |
| 5,222,403 A | | 6/1993 | Angelini et al. | 74/89.21 |
| 5,373,887 A | | 12/1994 | Glover | 160/206 |
| 5,469,905 A | | 11/1995 | McKinney et al. | 160/35 |
| 5,957,181 A | * | 9/1999 | Cohen-Ravid et al. | 160/32 |
| 6,035,917 A | * | 3/2000 | Cohen-Ravid | 160/35 |

FOREIGN PATENT DOCUMENTS

| | | | |
|---|---|---|---|
| DE | 866 843 | 2/1953 | |
| EP | WO 95/13451 | 5/1995 | E06B/9/58 |
| EP | 0756062 A1 | 1/1997 | |
| FR | 258795 | 1/1948 | |

* cited by examiner

*Primary Examiner*—David M. Purol
(74) *Attorney, Agent, or Firm*—Fulbright & Jaworski L.L.P.

(57) ABSTRACT

A security bar assembly has a plurality of bars that extend across an opening and have ends joined to drive chains. The bars may extend between two channels positioned on opposite faces of the opening, and may be slidable within the channels. The ends of the bars may be retained in the channels and the ends may have connections to chain links in opposing drive chains which are spaced apart a predetermined number of links to keep the bars a predetermined distance apart. A drive mechanism may be provided for moving the drive chains to slide the bars in the channels and a storage area adjacent the opening associated with the channels to retain the bars when they are not in place over the opening. Transfer mechanisms are provided for moving the security bars between a stored position and a position in which the bars engage the bar drive chain.

23 Claims, 20 Drawing Sheets

SECURITY BAR ASSEMBLY

CROSS REFERENCES TO RELATED APPLICATIONS

This application is a continuation-in-part of application Ser. No. 08/820,847 filed Mar. 20, 1997 now U.S. Pat. No. 6,035,917.

FIELD OF THE INVENTION

The present invention relates to a security bar assembly for a window or door opening in a building.

BACKGROUND OF THE INVENTION

There is a requirement for security bars to be used in front of windows and doors and particularly in front of storefronts and the like. Such security bars are needed to deter break in attempts into a building. There are various types of security bars and shutters available. For example, U.S. Pat. No. 5,957,181 (Cohen-Ravid) discloses a security bar assembly that has a plurality of bars extending across an opening. The bars have ends that join to drive chains. The bar ends are connected to chain links that have inserts disposed therein which cooperate with the end portions of the bars to drive the chain. A drive mechanism is disclosed that moves the drive chain such that the bars slide, and therefore cover, the opening.

SUMMARY OF THE INVENTION

The present invention provides a security bar assembly for an opening comprising a plurality of bars extending between two channels, the two channels positioned one on opposite faces of the opening, the bars slidable within the channels and having ends of the bars retained in the channels over the opening; the two channels having bar drive chains having adjoining chain links guided within the two channels; each of the bars having a connection at each end to engage in chain links in the drive chains, the engaged chain links spaced apart a predetermined number of chain links in each of the drive chains, and retaining the bars a predetermined distance apart; a drive mechanism for moving the drive chains at substantially the same speed to slide the bars in the channels over the opening, and a storage area adjacent the opening associated with the channels to retain the bars when they are not in place over the opening. Transfer mechanisms are provided for moving the security bars between a stored position and a position in which the bars engage the bar drive chain.

The present invention also provides a method of forming a security bar assembly in an opening including a plurality of security bars, the bars having retained ends extending between two channels on opposing faces of the opening and slidable therein, comprising the steps of moving drive chains in guides within the two channels, the drive chains having adjoining chain links; feeding opposing retained ends of a first bar to engage in first chain links of the drive chains so the first bar slides across the opening; feeding a second bar to engage in second chain links spaced a predetermined number of chain links from the first chain links, and continuing moving the drive chains and engaging further bars in further chain links spaced the predetermined number of chain links apart until the security bar assembly covers the opening.

There is also provided in the present invention a method of forming a security bar assembly in an opening including a plurality of security bars having retained ends engaged in chain links of drive chains guided in two channels on opposite faces of the opening and slidable therein, comprising the steps of moving the drive chains in guides within the two channels until a first bar having ends engaged in first chain links of the drive chains slides across the opening; continuing moving the drive chains in the guides until a second bar having ends engaged in second chain links of the drive chains slides across the opening, and further moving the drive chains with further bars engaged in further chain links until the security bar assembly covers the opening.

BRIEF DESCRIPTION OF THE DRAWINGS

In drawings which illustrate embodiments of the present invention.

DESCRIPTION OF THE PREFERRED EMBODIMENTS

Figure 1:
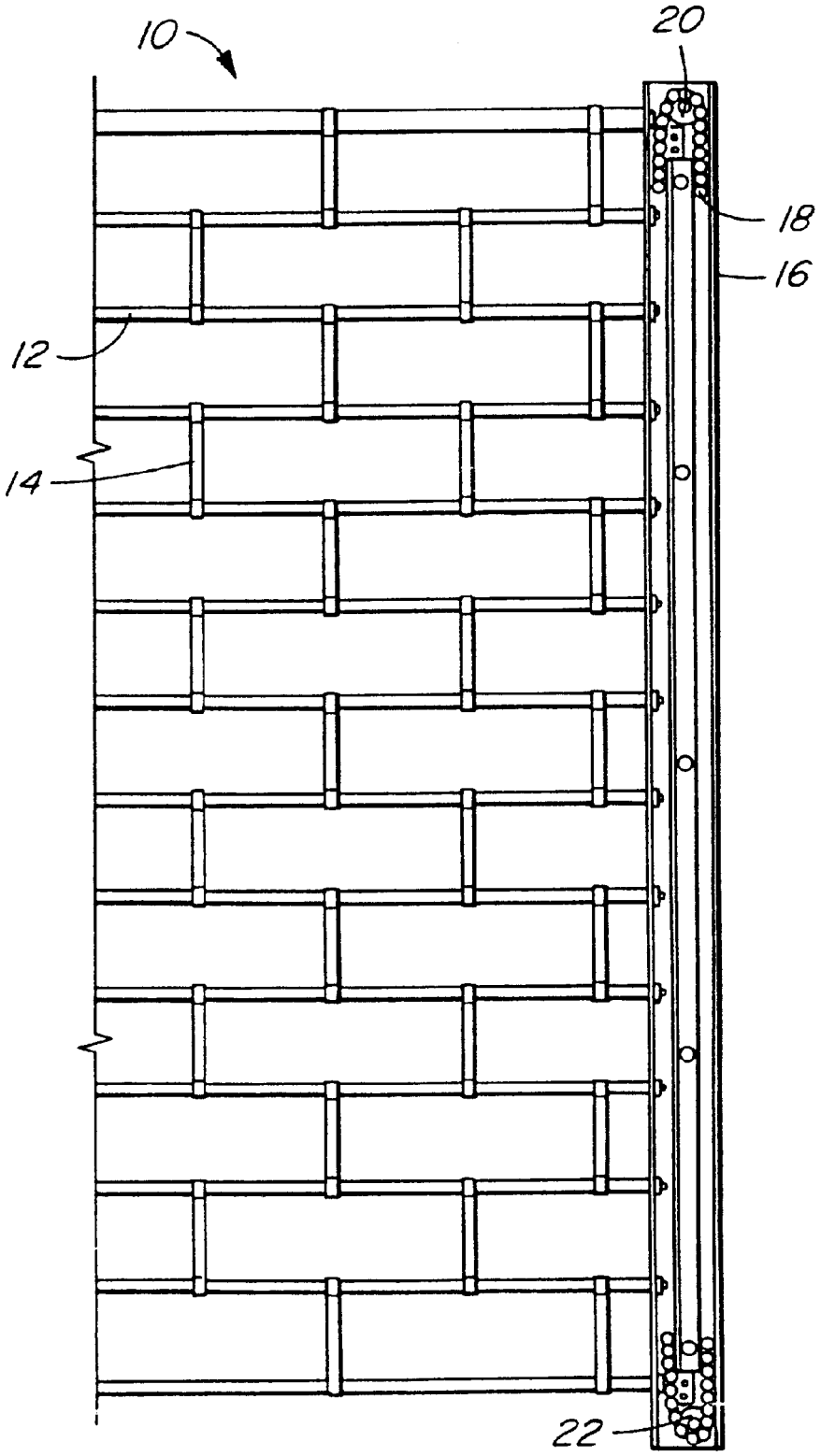
FIG. 1 is a front elevational view showing one embodiment of a portion of a security bar assembly with a drive chain in a side channel.

A security bar assembly 10 is shown in FIG. 1 with a plurality of bars 12 spaced apart by connecting links 14 which are interspaced between adjacent bars 12. The connecting links 14 for two adjacent bars 12 are interspaced between connecting links 14 joined to bars above and below the two adjacent bars 12. The ends of each bar 12 are inserted into channels 16 which have a drive chain 18 which moves on a first sprocket 20 and a second sprocket 22.

Figure 2:
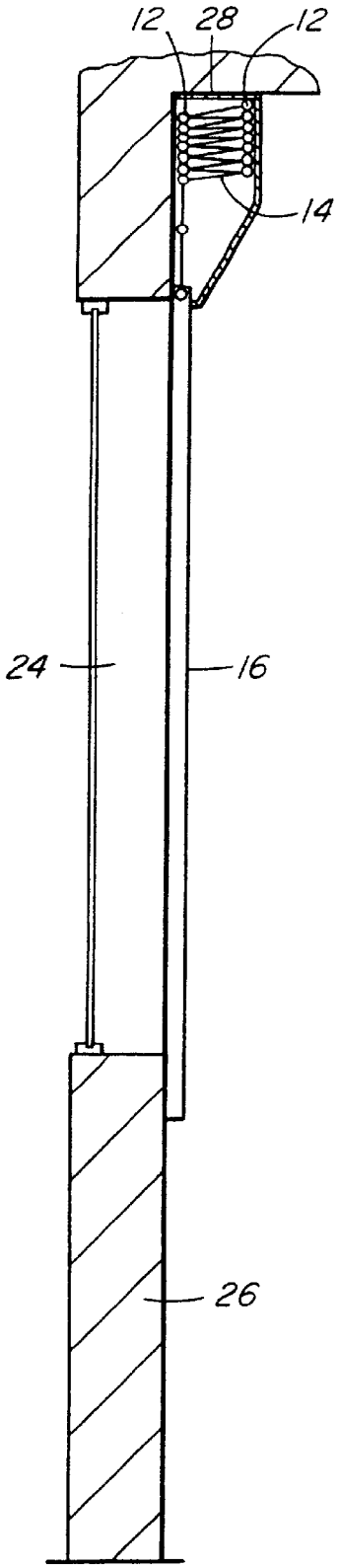
FIG. 2 is a side sectional view showing a side channel and container for holding bars with connecting links in a stored configuration above an opening.
Figure 3:
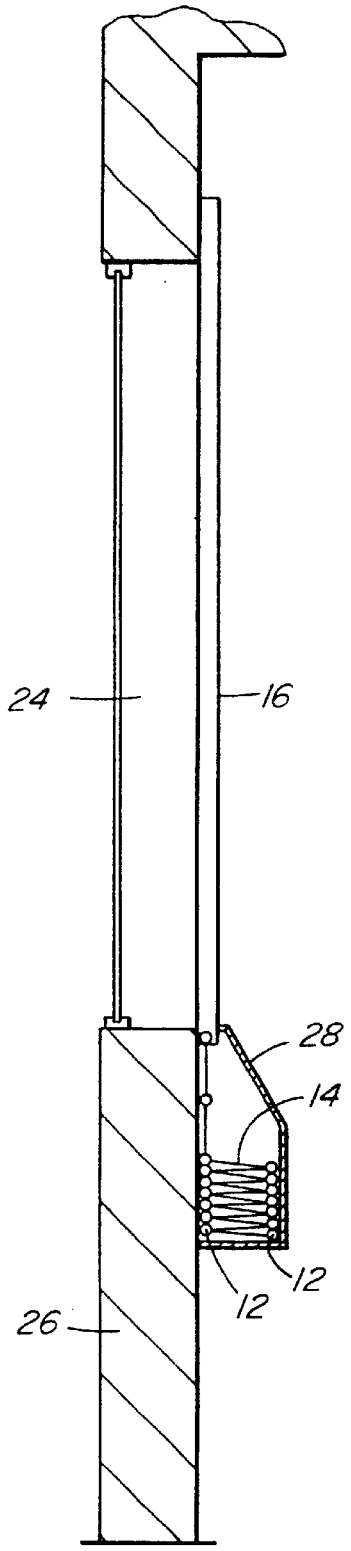
FIG. 3 is a side sectional view showing a side channel and container for holding bars with links in a stored configuration below an opening.

FIG. 2 shows a section of a security bar assembly 10 positioned in front of an opening 24 in a wall 26. A storage area such as a container 28 is shown above the opening 24 and folded security bars 12 with connecting links 14 are shown in the container 28. FIG. 3 shows a similar sectional view of a security bar assembly to that shown in FIG. 2, the difference being that the container 28 is positioned below the opening 24.

Figure 4:
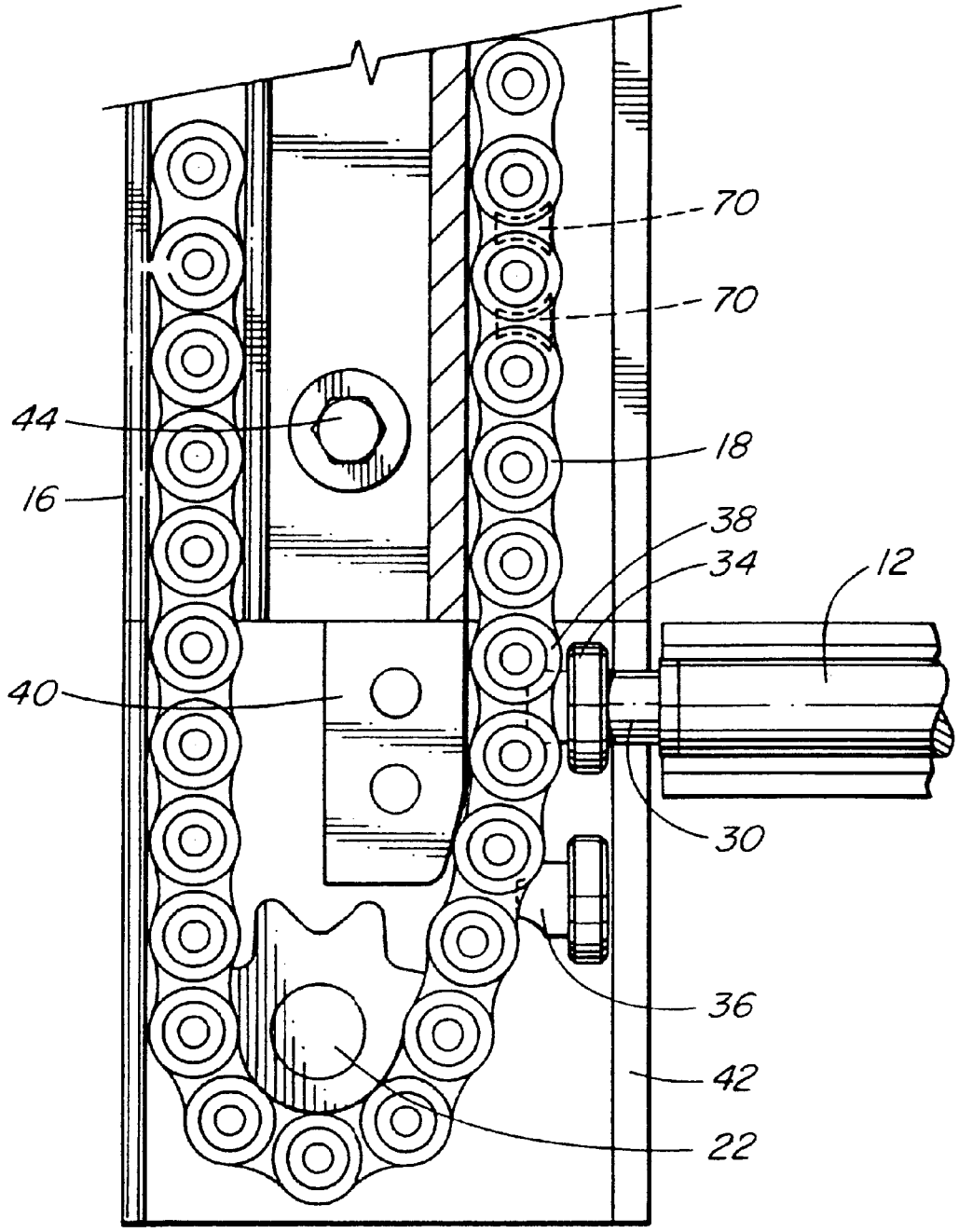
FIG. 4 is a detailed front view showing a drive chain and sprocket for engaging ends of bars.

Details of the drive chain 18 are shown in FIG. 4 rotating about the second sprocket 22 which has an axis of rotation projecting from the wall substantially perpendicular to the bars 12. Each bar 12 has at either end a projection 30 which passes through a side slot 32 in the side of the channel 16. The projection 30 has a disk member 34 to retain the end of the bar 12 within the channel 16 and has an end piece 36 that extends to fit exactly in an aperture of a chain link 38 of the drive chain 18. A chain guide 40 in a lower channel member 42 acts to push the drive chain 18 away from the sprocket 22 so that the end piece 36 of each of the bars 12 do not interfere with the teeth of the sprocket 22. The channels 16 are held to the wall beside the opening 24 by bolts 44 and a snap-on cover 46, shown in FIG. 5, extends over the channel 16. As the channel 16 is preferably placed on the inside of the building, the cover 46 can only be reached from the inside.

Figure 6:
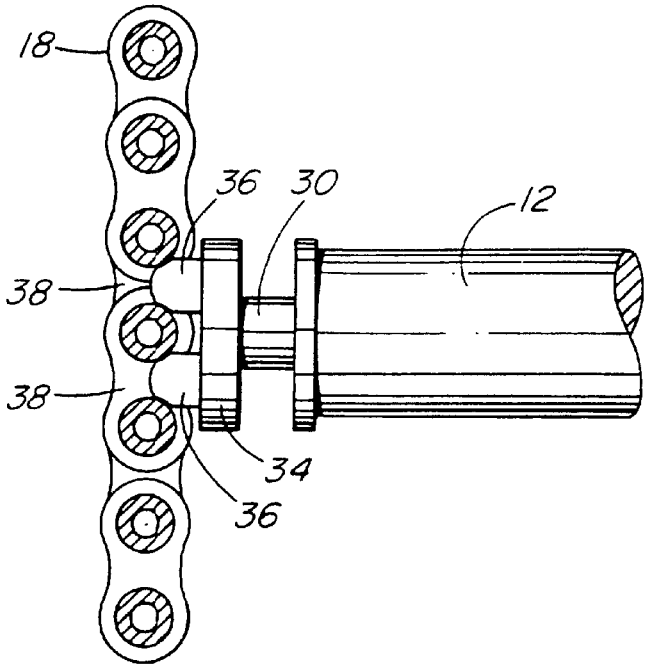
FIG. 6 is a detailed sectional front view showing another embodiment of a connection between a bar and a drive chain.

A multiple tooth connection is shown in FIG. 6 wherein the disk member 34 on the projection 30 of the bar 12 has two end pieces 36 that are spaced apart the exact distance so that they engage in adjacent apertures between chain links 38. The two end pieces 36 prevent the bar 12 from rotating.

Figure 5:
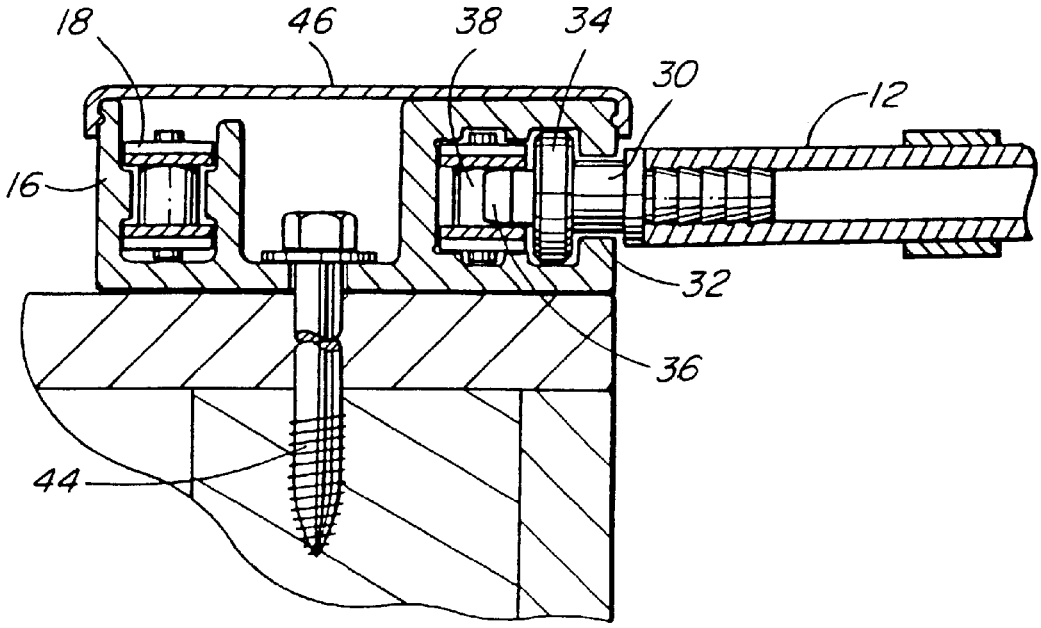
FIG. 5 is a detailed sectional top view showing a drive chain in a channel guide connected to a bar across an opening.
Figure 7:
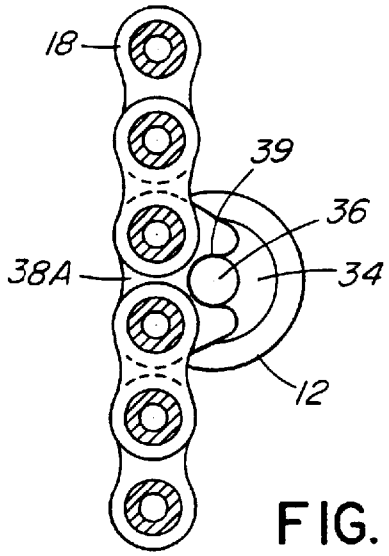
FIG. 7 is a detailed sectional side view showing a further embodiment of a connection between a bar and a drive chain.

Whereas FIGS. 4, 5 and 6 show the drive chains 18 with sprocket axes substantially at right angles to the bars 12, FIG. 7 shows another embodiment wherein the sprocket axes are substantially parallel to the bars 12. A modified chain link plate 38A is shown with an engagement groove 39 spaced away from the drive chain 18. The end piece 36 of the bar 12 fits within the engagement groove 39 and holds the bar 12 as though it were held in the chain link in the manner shown in FIGS. 4, 5 and 6. The drive chain 18 and sprockets 20,22 are then turned through 900 so the channels 16 can be placed in the sides of an opening.

Figure 8:
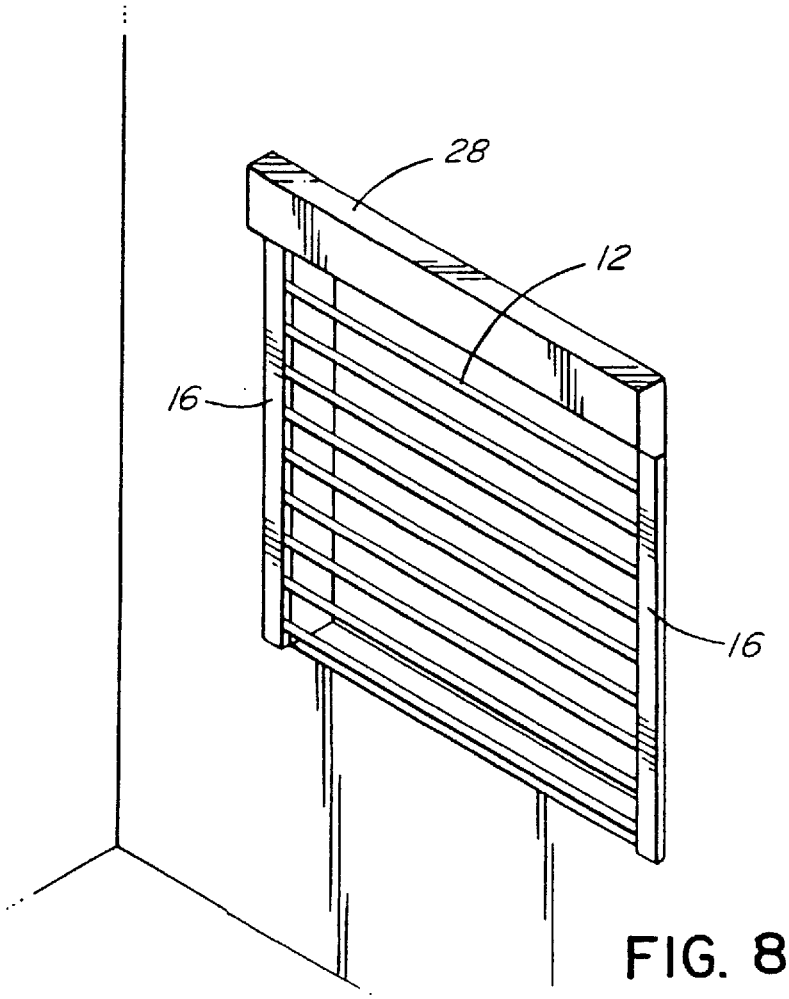
FIG. 8 is a perspective view showing bars connecting to side channels with an upper container to store the raised bars above the opening.
Figure 9:
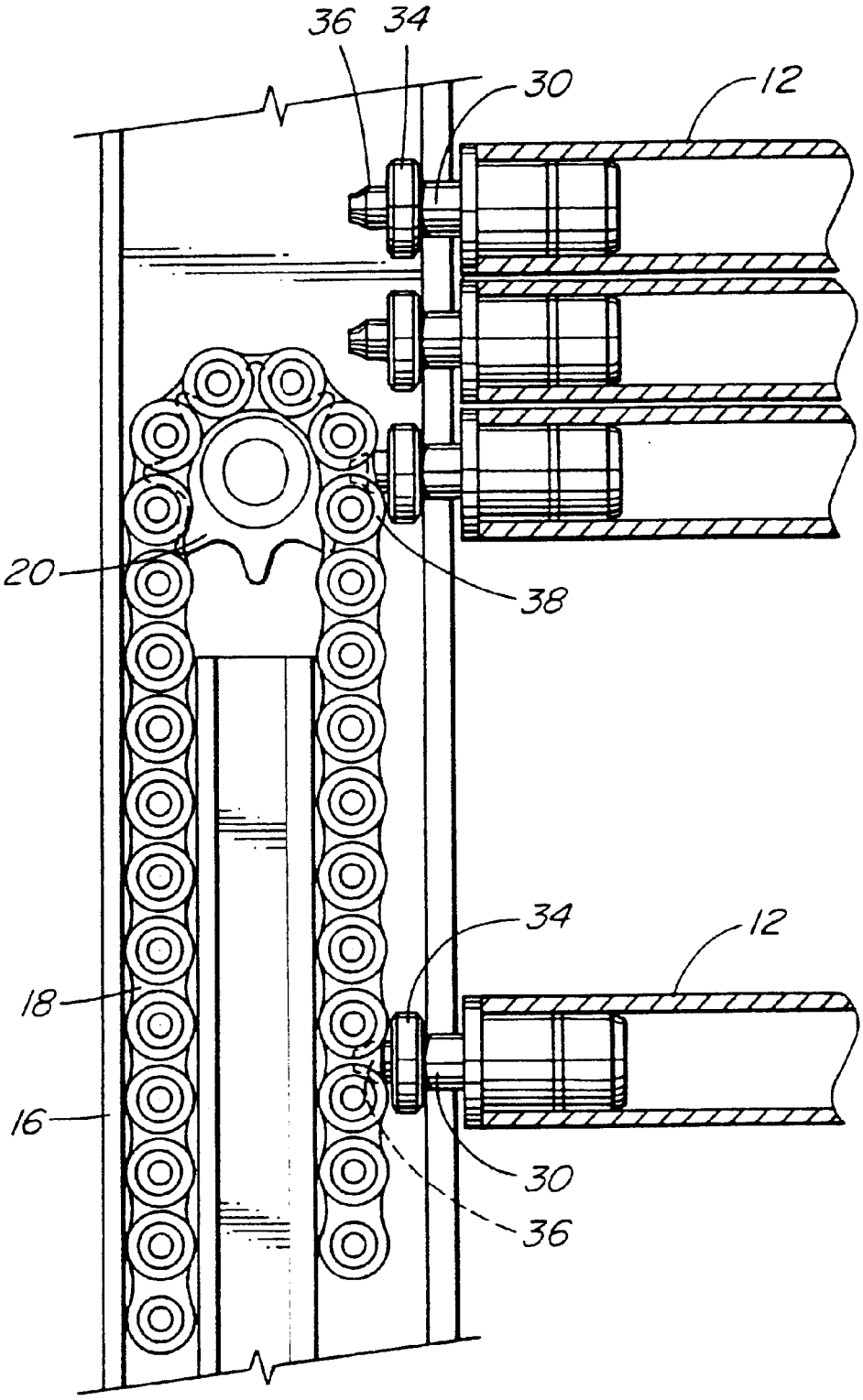
FIG. 9 is a detailed front elevational view showing the ends of bars joined to chain links and stored in a container above the opening.
Figure 10:
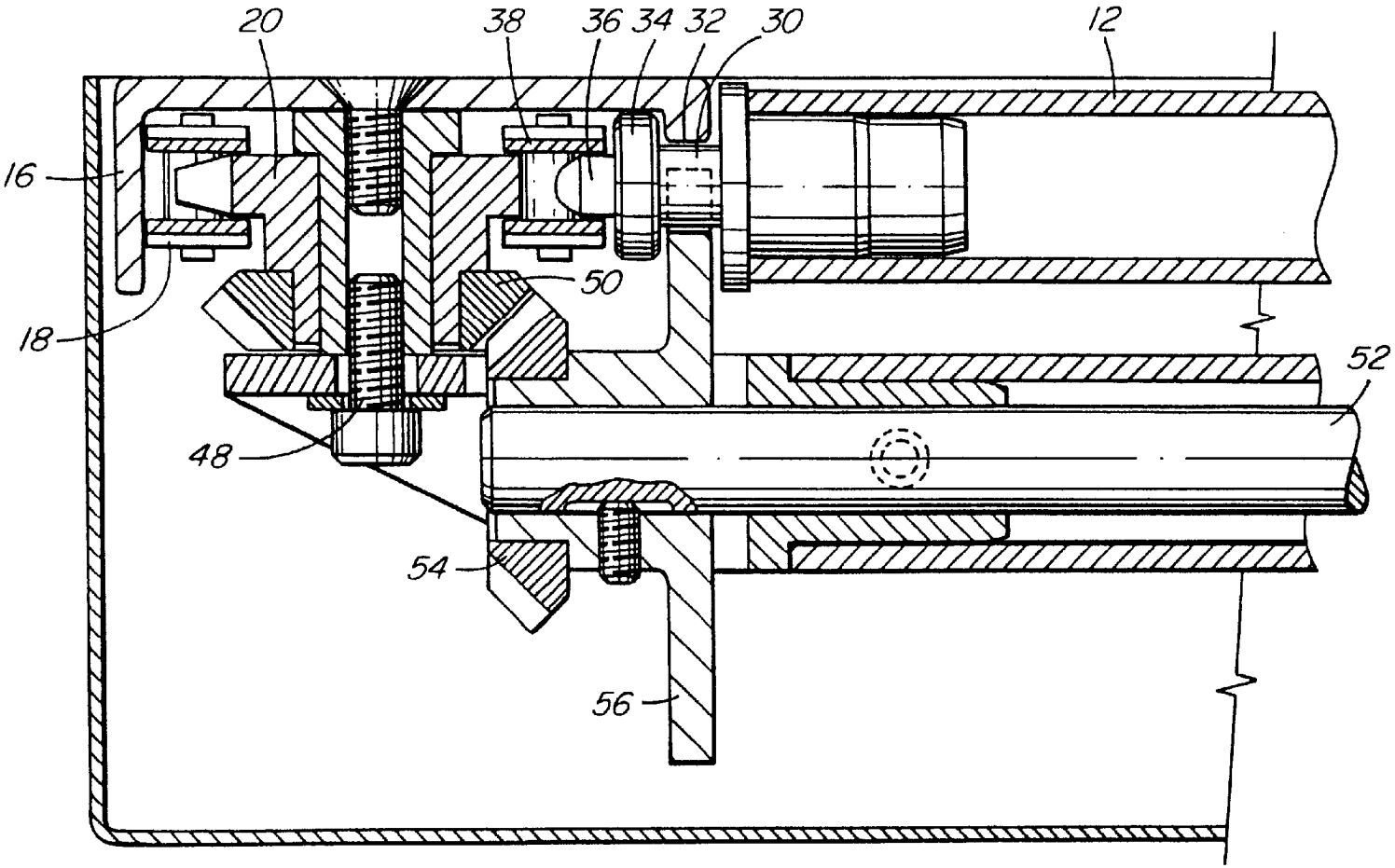
FIG. 10 is a detailed sectional top view showing the escapement mechanism for ensuring bars from an upper container engaging with chain links a predetermined number apart on a drive chain.
Figure 11:
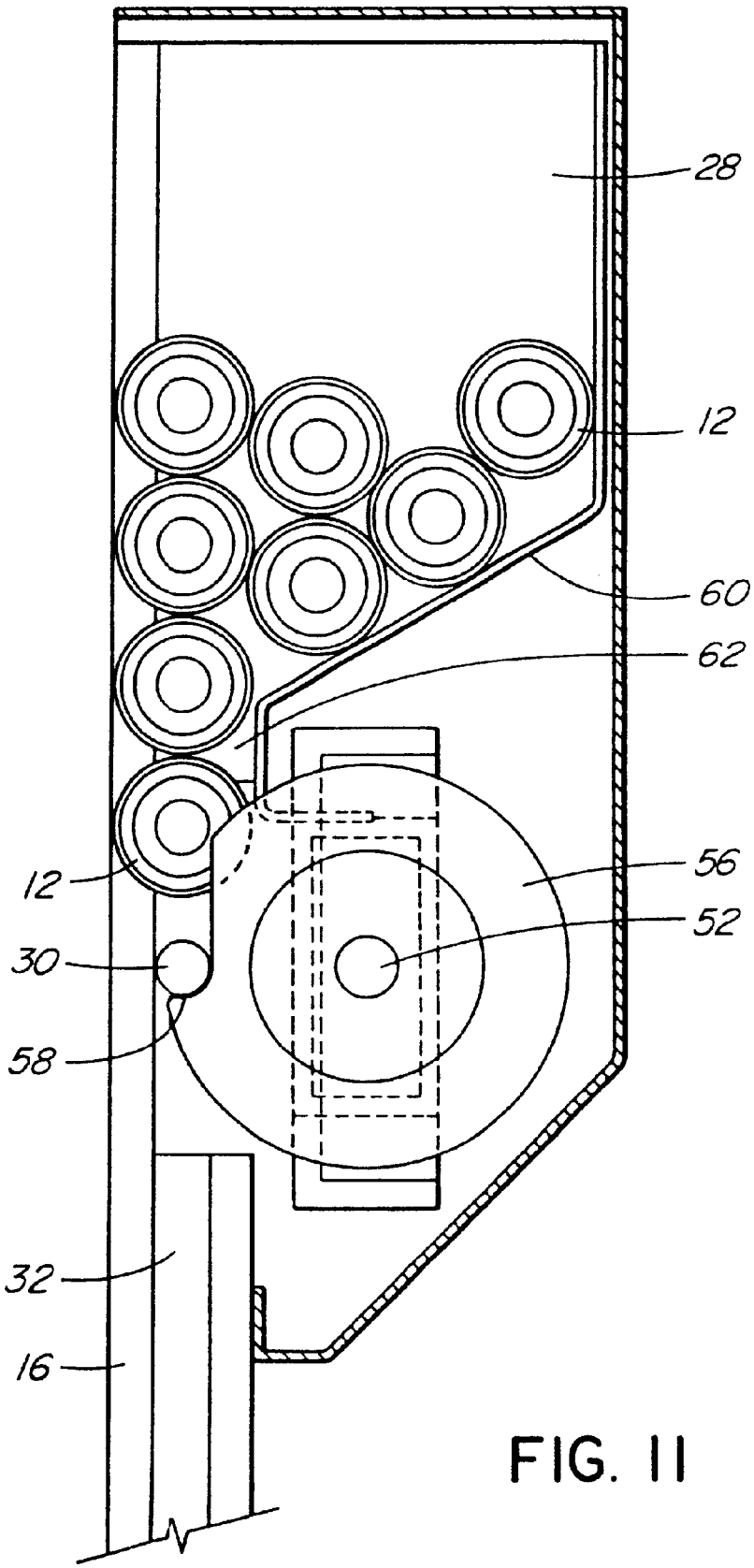
FIG. 11 is an end view showing a container above an opening with bars and an escapement mechanism for feeding the bars into opposing chain links of drive chains on both sides of an opening.

Whereas FIG. 1 shows connecting links 14 between bars 12, FIG. 8 is a perspective view showing a security bar assembly with bars 12 and no connecting links joining the bars 12 together. This is possible because the opening is not too wide and the bars 12 cannot easily be pried apart. FIGS. 9, 10 and 11 illustrate the mechanism for the shutter assembly shown in FIG. 8. The drive chain 18 as shown in FIG. 9 rotates on the first sprocket 20 which is an eight tooth drive sprocket having one tooth missing. Every time the first sprocket 20 rotates and the missing tooth is open, the end piece 36 of the projection 30 from each bar 12 engages in a connection aperture in the chain link 38 and is then conveyed across the opening as the drive chain 18 moves around the sprocket 20. The missing tooth on the sprocket 20 is shown more clearly in FIG. 10 with the end piece 36 engaging in the chain link 38 of the drive chain 18. The first sprocket 20 rotates on axle 48 which in turn is driven by a driven bevel gear 50. A drive shaft 52 extends across the opening between the two drive chains 18. While not shown, the drive shaft 52 is driven by a gear motor that can rotate in either direction to slide the bars 12 across the opening. On either end of the drive shaft is a drive bevel gear 54 that engages the driven bevel gear 50 on the axle 48 to drive the first sprocket 20. Thus, rotation of the drive shaft 52 rotates both first sprockets 20 on either side of the opening in the channels 16 and moves the chains 18 at exactly the same speed so that the bars 12 remain substantially evenly spaced apart when they are engaged in individual chain links of the drive chain 18.

An escapement wheel 56 is attached to the drive bevel gear 54 and has a notch 58 to engage the projection 30 of a bar 12. Initially the bars 12 are stored in a stored configuration which in the embodiment shown is a container 28 above the opening and positioned above the cross shaft 52. A guide strip 60 guides the bars 12 into a slot 62 where they individually fall. As the escapement wheel 56 rotates the projection 30 of the first bar 12 is engaged by the notch 58 which moves the bar 12 down until the end piece 36 of the bars 12 engages in the connection aperture of the chain link 38 that is positioned on the sprocket 20 at the location where the tooth is missing. This applies for both sprockets 20 for both drive chains 18 on either side of the opening. As the drive chains 18 move downward, the projections 30 of the bars 12 fit into the slots 32 of the channels 16. The escapement wheel 56 continues to rotate until it picks up a second bar 12 and lowers that in the slots 32 of the channels 16, at the same time each end piece 36 of the bars 12 fits into a connection aperture of a chain link at the missing tooth position on the sprocket 20. This continues until all of the bars 12 are spaced apart across the opening 24. For an eight tooth sprocket 20, the end piece 36 will engage in every eighth chain link. In one embodiment an eight tooth drive sprocket with one tooth missing provides 4" spacing for the bars. In a further embodiment the speed of the drive chain represents 2" per second both up and down.

When raising the bars, the drive chain moves in the opposite direction as does the escapement wheel 56. The notch 58 in the escapement wheel 56 picks up the projections 30 of each bar 12 and disengages the end piece 36 from the drive chain 18. The bar 12 is raised and pushed into the container 28 pushing other bars upwards. The container 28 is preferably lined with soft material to reduce the noise of the bars 12. As the bars 12 move upwards they spread out to take up the space of the container 28.

Whereas the mechanism shown in FIGS. 9, 10 and 11 illustrates the container 28 being on top of the opening, in another embodiment the container 28 may be positioned below the opening. The same mechanism as is illustrated would be used for feeding individual horizontal bars 12 to engage with the chain 18. However, there is a spring mechanism (not shown) provided to push each horizontal bar 12 up to ensure that each of the projections 30 engages in the notch 58 of the escapement wheel 56.

In further embodiments, the security bar assembly may have the bars 12 substantially vertical, with the channels 16 and drive chains 18 at top and bottom. In this configuration, the engagement of the bars 12 in the drive chains 18 does not rely on gravity.

When connecting links 14 join the bars together, the escapement wheel is not essential providing the first bar 12 is always retained in a chain link 38 of the drive chain 18. The sprocket with one tooth missing only allows the end piece 36 of a bar 12 to engage where that sprocket tooth is missing. With the mechanism shown in FIG. 4, a chain guide 40 pushes the drive chain 18 out from the sprocket 20,22 so that the sprocket teeth do not interfere with the end piece 36 of the bar 12 engaging in a chain link 38 of the drive chain 18. In this mechanism other spacing arrangements are provided. In one embodiment plugs 70 such as that shown in FIG. 4, are positioned in each of the so-called connection apertures or spaces in the chain links 38. The plugs 70 are preferably made of plastic and move with the chain links 38, thus preventing the end pieces 36 of the bars 12 engaging in a chain link 38. By spacing the plugs 70 a predetermined number of chain links apart along the drive chain, the bars 12 are spaced apart the predetermined distance as they cannot engage in the chain 38 links where the plugs are located.

Figure 12:
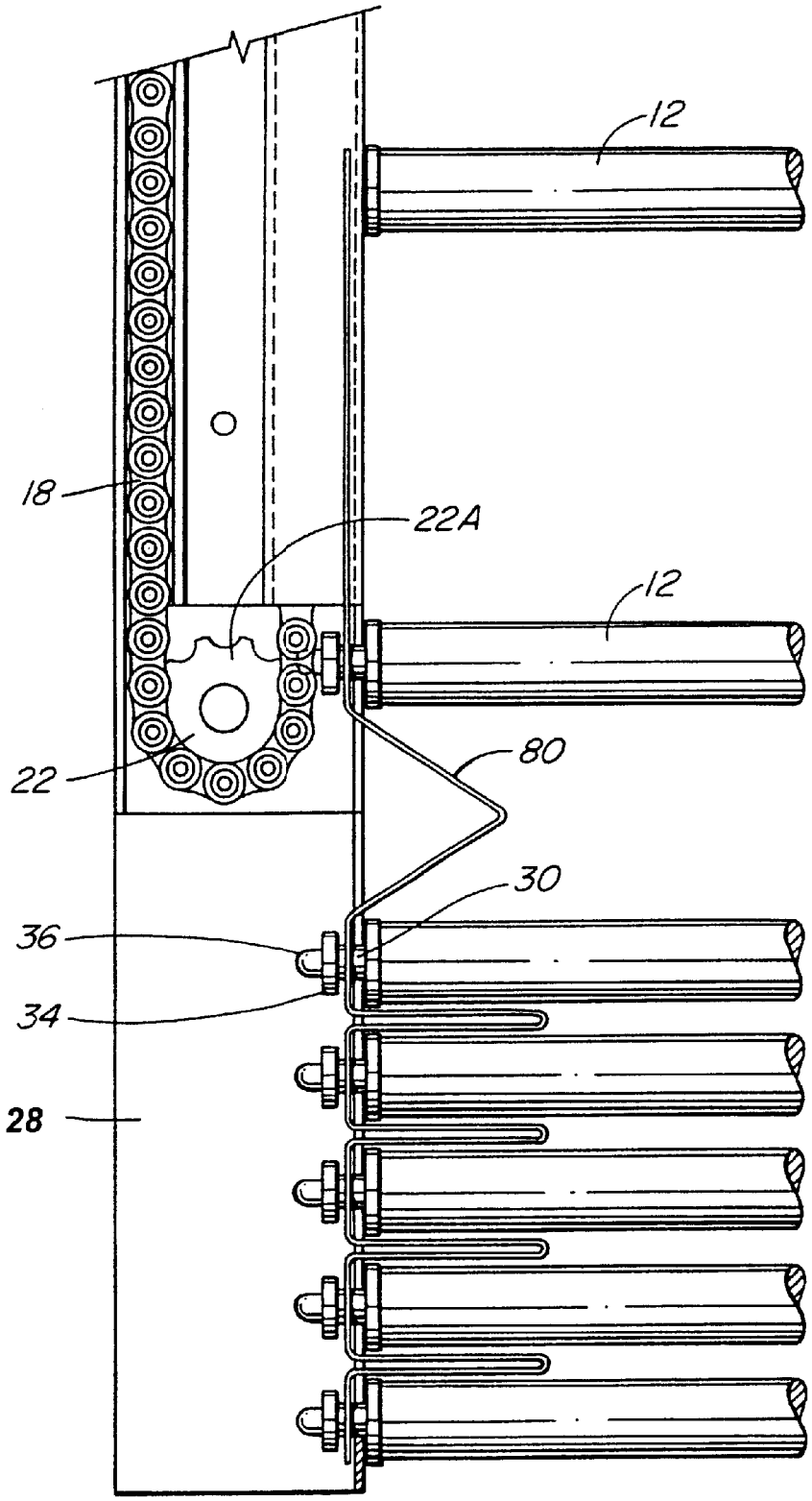
FIG. 12 is a front elevational view showing another embodiment of a security bar assembly with flexible connection spacers between adjacent bars.

Another embodiment to maintain the predetermined distance apart is shown in FIG. 12. In this embodiment, the container 28 to retain the bars 12 is positioned below the opening under the second sprocket 22.

The sprocket 22 is a truncated sprocket, that is to say, a sprocket with the tips of the teeth 22A removed. By having truncated teeth, the end pieces 36 of the bars 12 do not interfere with the teeth 22A.

Whereas a truncated sprocket is shown for this embodiment, a sprocket with a missing tooth as shown in FIG. 9 may be used or, alternatively, chain guides 40, as shown in FIG. 4 may be used to move the chain away from the sprocket.

Flexible connection spacers 80 are shown attached to the projections 30 at each end of all the bars 12. The spacers determine the predetermined distance between the bars 12 when they are across the opening, but fold as shown in FIG. 12 when the bars are moved across the opening into the container 28 so they are able to nestle up to each other. When the first bar 12, which is never disengaged from the drive chains 18, moves up, the spacers 80 pull the adjacent bar behind it to engage in chain links of the drive chains 18.

Figure 13:
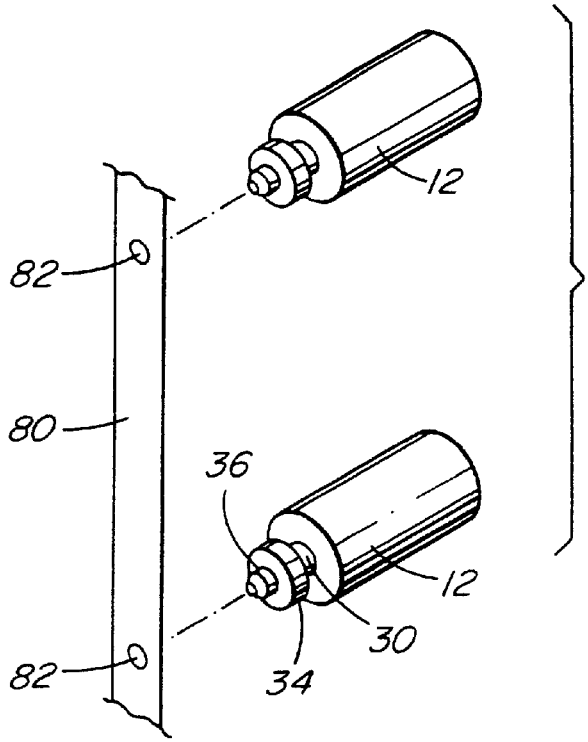
FIG. 13 is a perspective view showing tape flexible connection spacers.
Figure 14:
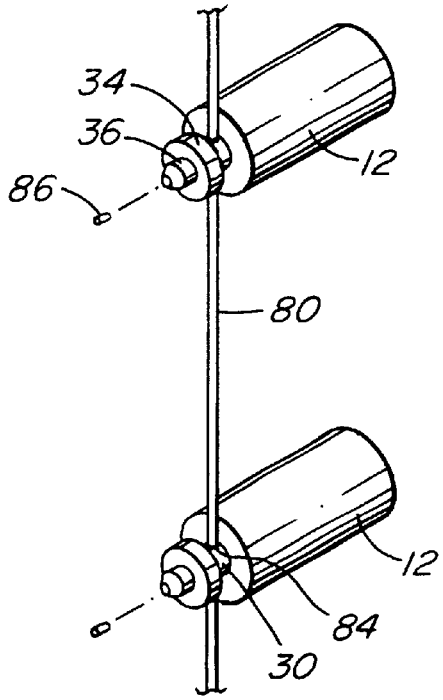
FIG. 14 is a perspective view showing cable flexible connection spacers.
Figure 15:
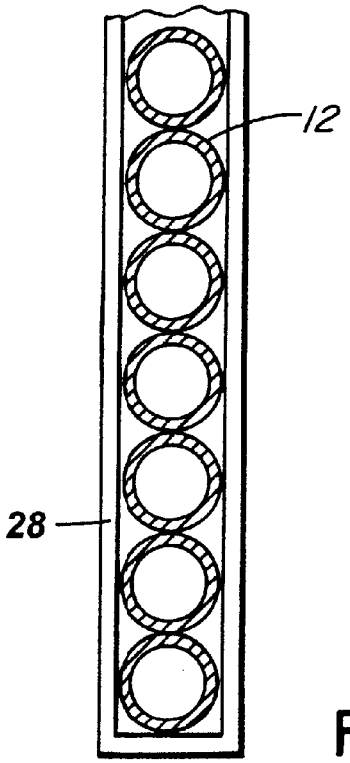
FIG. 15 is a side sectional view showing a linear container for retaining bars.
Figure 16:
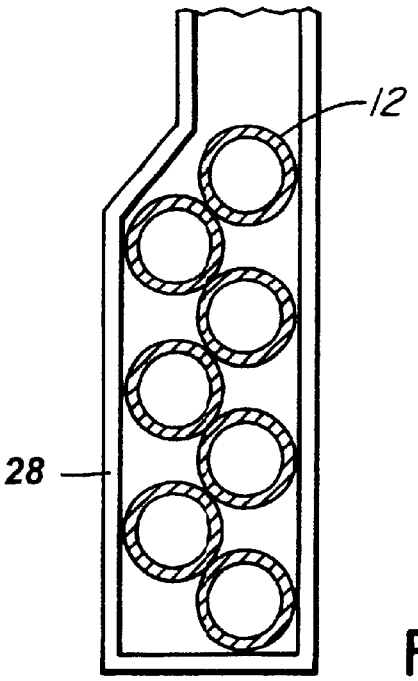
FIG. 16 is a side sectional view showing a non-linear container for retaining bars.

As shown in FIG. 13, the flexible connection spacer 80 is a tape with holes 82 that fit over the projection 30 at the ends of the bars 12. In another embodiment separate tapes of predetermined lengths are attached between adjacent bars 12. In FIG. 14, the flexible connection spacer 80 is a cable and fits through a hole 84 in the projections 30 at the ends of the bars 12. Set screw clamps 86 through the end pieces 36 secure the cable spacer 80 to maintain the distance between the bars 12. FIG. 15 shows the container 28 shaped so that the bars 12 are positioned linearly therein. FIG. 16 shows the container 28 shaped so that the bars are positioned non-linearly. The container 28 is positioned below the opening as shown in FIG. 12.

Figure 17:
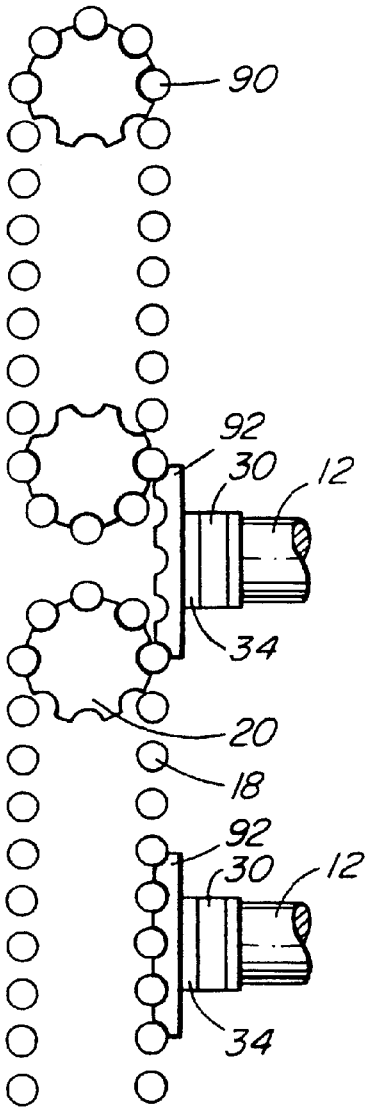
FIG. 17 is a side view showing a bar drive chain and a storage drive chain with bars spaced apart according to a further embodiment of the invention.
Figure 18:
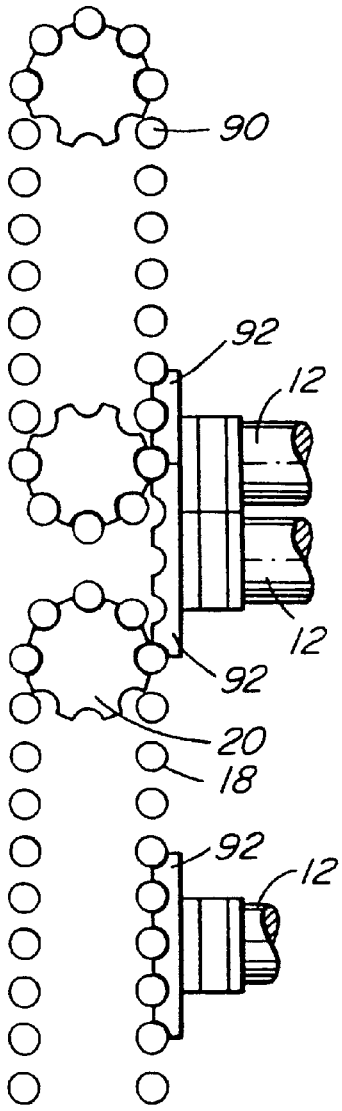
FIG. 18 is a side view similar to FIG. 17 showing two bars nestled together on the storage drive chain.
Figure 19:
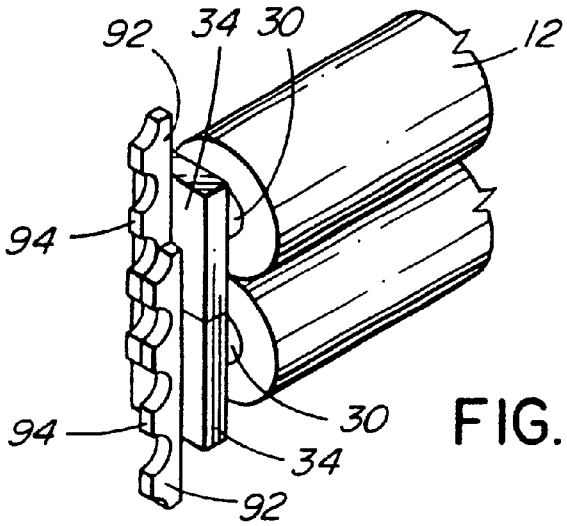
FIG. 19 is a perspective view showing two bars with elongated anchors overlapping and the bars nestled together.

In FIGS. 17, 18 and 19, another embodiment is shown which has a second set of drive chains referred to as storage drive chains 90. These storage drive chains 90 are positioned in line with the bar drive chains 18 either adjacent the first sprocket 20 positioned above the opening or positioned adjacent the second sprocket 22 below the opening. In the embodiments shown, the sprockets are all truncated sprockets as shown in FIG. 12, so the sprocket teeth do not interfere with the connections between the drive chains and the bars 12. The bars 12 have projections at each end to fit in side slots 32 of the channels 16 as shown in FIG. 5. Disk members 34 on the ends of the projections have elongated anchors 92 which have four protrusions 94 in line to engage in apertures of adjacent chain links. As shown in FIG. 19, the anchors 92 have a width less than half the width of the space between link plates in the chain link, and the anchors are arranged to overlap so that adjacent bars 12 have anchors offset so that the bars can be retained together when in the container 28.

In FIG. 17 the bars 12 are shown spaced apart with a first bar having the anchor 92 spanning between the bar drive chain 18 and the storage drive chain 90. When the bars 12 are moved into storage, the bar drive chain 18 moves the anchor 92 so that it engages with the storage drive chain 90, this chain is driven intermittently and it moves just sufficient for the top anchor 92 to clear the bar drive chain 18. Then, as shown in FIG. 18 the next bar 12 is moved up and the anchor 92 of the lower bar overlaps the anchor 92 of the first bar so the two bars 12 nestle together. Thus, when the bars are stored they are all nestled together on the storage drive chain 90.

To lower or raise the bars 12, depending upon whether the storage drive chain 90 is positioned above or below the opening, the storage drive chain 90 moves intermittently feeding the bars so the anchors 92 engage into the continuously moving bar drive chain 18. The intermittent movement of the storage drive chain 90 is arranged to ensure that the space between bars, i.e., the number of chain links, is always the same across the opening.

Figure 20:
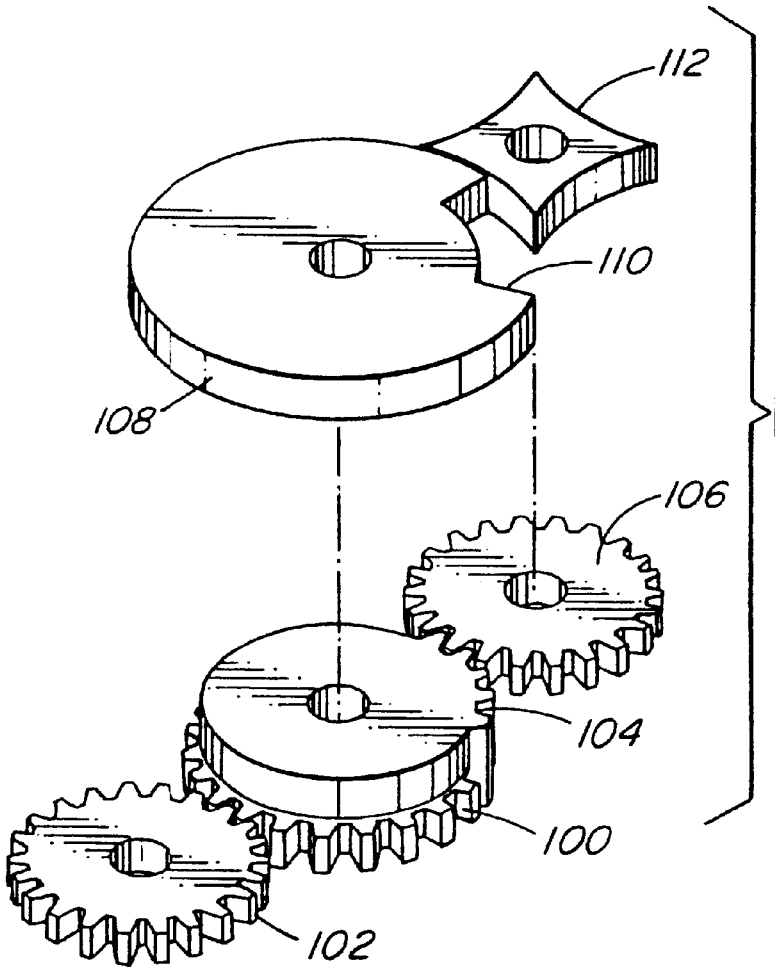
FIG. 20 is a schematic perspective view showing the intermittent drive mechanism for the storage drive chain according to an embodiment of the invention.

FIG. 20 is a schematic perspective view of the drive mechanism for the bar drive chain 18 and the storage drive chain shown in FIGS. 17 and 18. An intermediate gear 100 meshes with a continuous drive gear 102 to drive the first or second sprockets 20,22 of the bar drive chain. An intermittent drive gear segment 104 is formed integral with the intermediate gear 100 and drives an intermittent drive ear 106 which drives the storage drive chain 90. An intermittent lock wheel 108 is keyed to the intermediate ear 100 and has a cutout 110 which is positioned above the intermittent drive gear segment 104. A locking dog 112 is attached to the intermittent drive gear 106 and only permits the intermittent drive gear 106 to rotate when the intermittent drive gear segment 104 meshes with the intermittent drive gear 106. At all other times the intermittent gear locking dog 112 cannot rotate as it is prevented by the periphery of the locking wheel 108.

The drive mechanism as described may be a gear drive motor to rotate the drive shaft 52. In a preferred embodiment a brake is included with the motor so the bars 12 cannot be shifted when the power is off. In another embodiment a manual rotating crank arm (not shown) may be provided so that if there is power failure the bars 12 can be either lowered or raised manually simply by rotating the drive shaft 52.

Furthermore, for emergencies, a clutch or release pin may be included between the gear drive motor and the drive shaft 52 to disengage the gear motor from the drive shaft 50. This allows the bars 12 to be pushed up or down as the drive chains move freely. The drive chains 18 rotate on the sprockets 20,22 and when each horizontal bar comes to the ends of the drive chains 12 it disengages from the drive chain 18 and either falls onto the floor or, alternatively, falls into a container depending upon the particular embodiment provided, thus providing an escape opening for an emergency. The security bar assembly is preferably placed on the inside of a building as intruders are not easily able to get at the operating mechanism.

Figure 24:
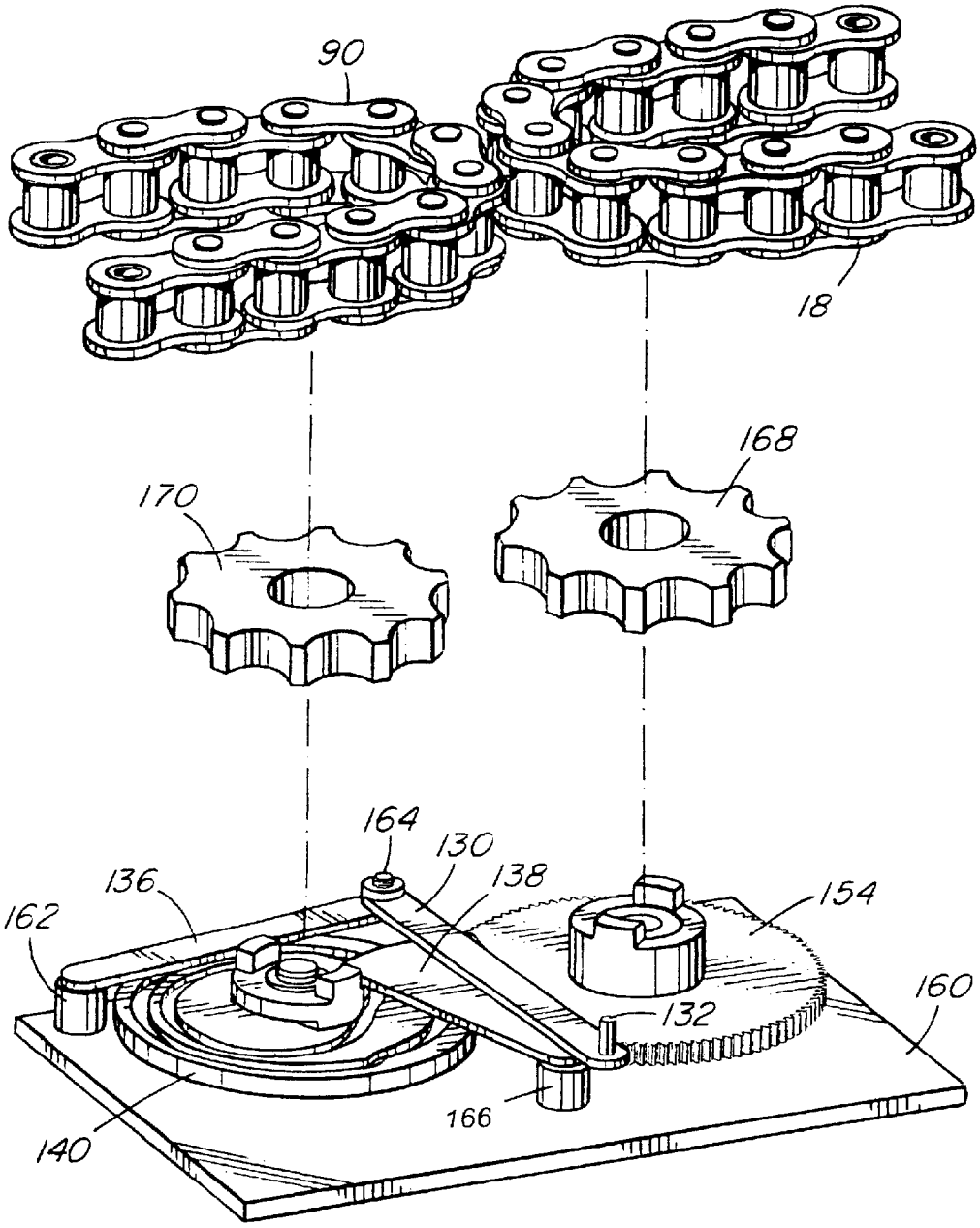
FIGS. 24 and 25 are views of the bar transfer mechanism shown in FIG. 23, showing an exploded view of the partially broken away sprockets and chains of the drive chain and the storage drive chain.
Figure 25:
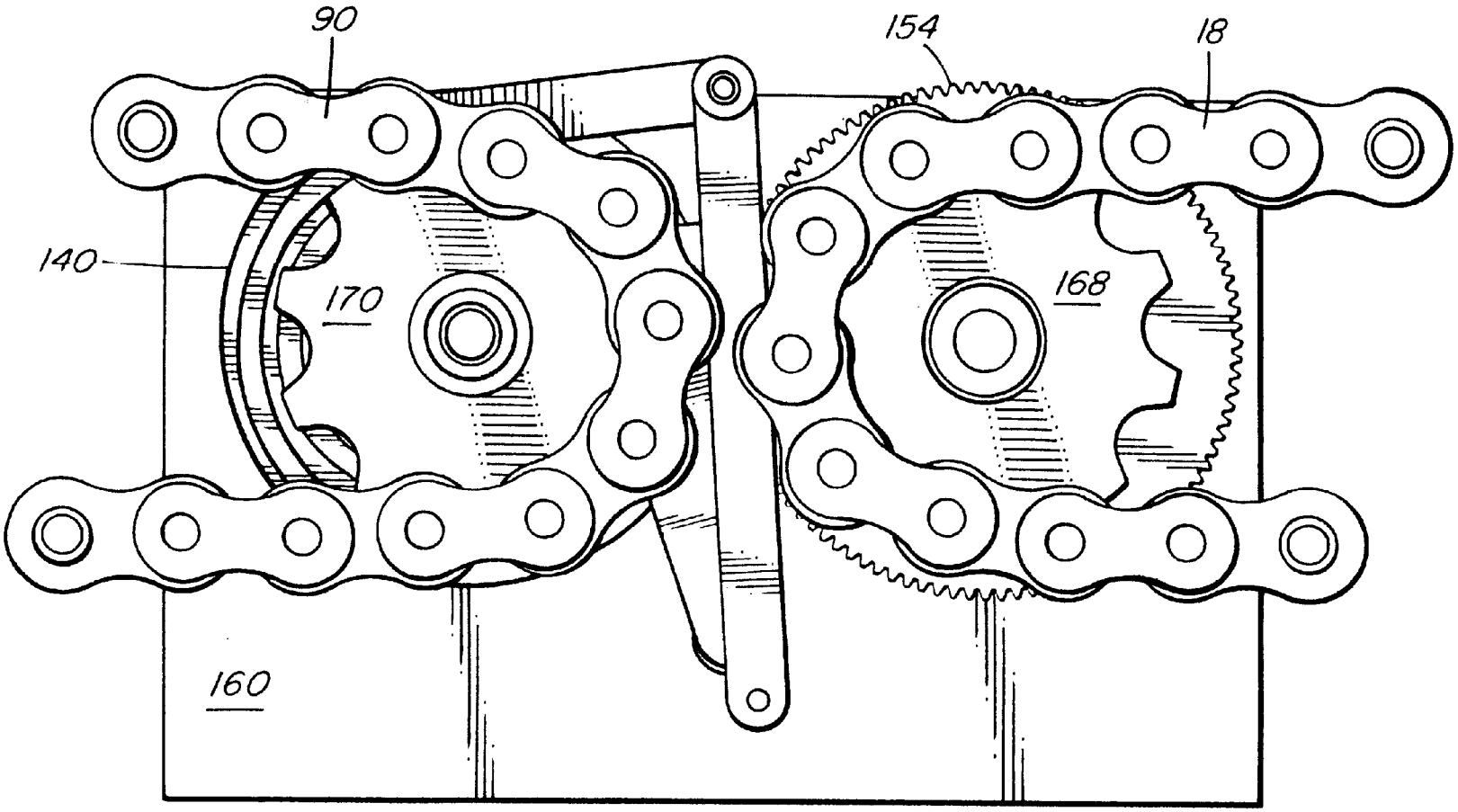
Figure 26:
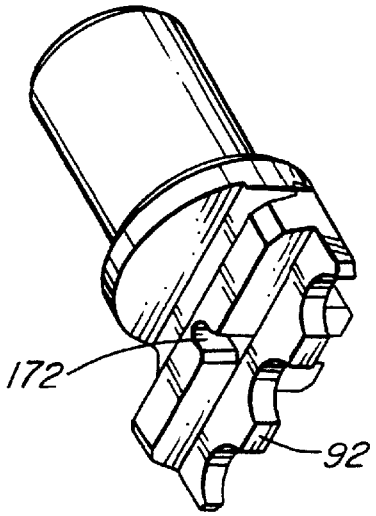
FIG. 26 is an isometric view showing the top of a bar end with an elongated anchor for engaging a chain and a feed slot for engaging the feed pin of a bar transfer mechanism.
Figure 28:
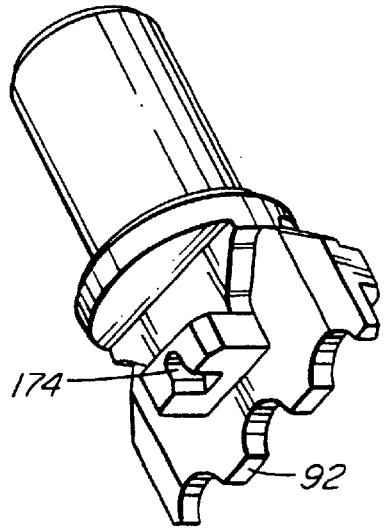
FIG. 28 is an isometric view showing the bottom of the bar end of FIGS. 26 and 27, showing the difference in construction of the feed slot on the bottom of the bar end compared to the top of the bar end.
Figure 27:
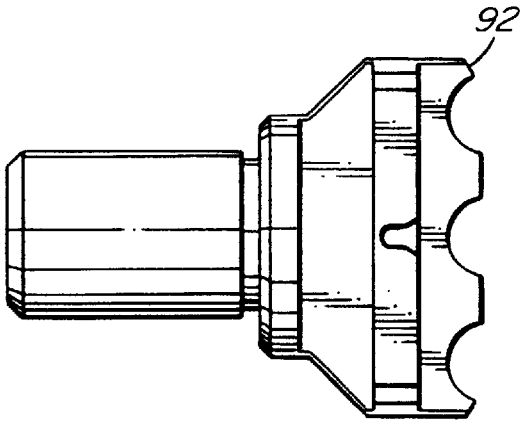
FIG. 27 is a top plan veiw of the bar end of FIG. 26.
Figure 29:
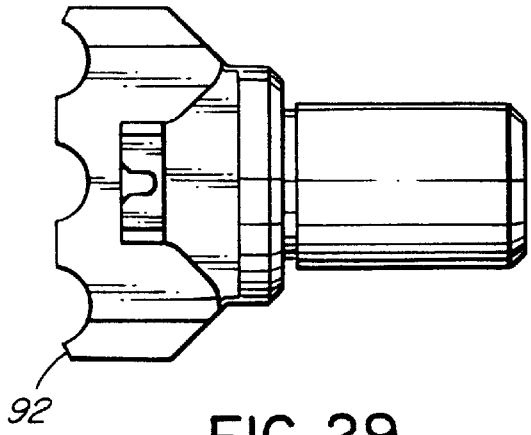
FIG. 29 is a bottom plan view of the bar end of FIGS. 26, 27 and 28.

FIGS. 23 through 29 illustrate an alternative embodiment of a transfer mechanism for transferring bars 12 between drive chain 18 and storage chain 90. In the illustrated embodiment, transfer arm 130 is provided with a transfer arm pin 132 which in operation moves about a rotational path, shown by dotted lines 134. Transfer arm pin 132 engages a bar end, as shown in FIGS. 26 through 29, to transfer a bar 12 from drive chain 18 to storage drive chain 90. The motion of transfer arm pin 132 along path 134 is actuated by a mechanism comprising transfer arm 130, lever arm 136 and lifting arm 138. Lever arm 136 is pivotably connected to back plate 160 at lever arm mount mount 162, and is pivotably connected to transfer arm 130 at arm joint 164. Lifting arm 138 is pivotably connected to back plate 160 by lifting arm mount 166. Arms 130, 136 and 138 are in turn actuated by cam wheel 140. Outer groove 142 in cam wheel 140 accommodates lever arm pin 146 provided on lever arm 136, so that rotation of cam wheel 140 moves lever arm 136 as lever arm pin 146 travels in outer groove 142. Similarly, inner groove 144 accommodates lifting arm pin 148 provided on lifting arm 138, so that rotation of cam wheel 140 moves lifting arm 138 as lifting arm pin 148 travels in outer groove 142. The motion of lifting arm 138 is communicated to transfer arm 130 by actuating pin 150 which travels in lifting arm groove 152. Cam wheel 140 is driven by drive wheel gear 154 via transfer gear 156, shown in phantom in FIG. 23. Cam wheel 140 may be adapted to drive storage drive chain 90, and drive wheel gear 154 may be adapted to drive drive chain 18, as shown in FIG. 24, which shows drive chain sprocket 168 and storage chain sprocket 170 in exploded view.

FIGS. 26 through 29 illustrate a bar end having elongated anchors 92, for engaging drive chain 18 and storage chain 90. As an alternative to the chain transfer mechanism illustrated in FIGS. 17 and 18, the bar ends of FIGS. 26 through 29 are adapted for use with the chain transfer mechanism of FIGS. 23 through 25. To engage transfer arm pin 132, the bar ends are provided with a top feed slot 172 and a bottom feed slot 174, each of which are adapted to be engaged by transfer arm pin 132 to carry bar 12 between storage drive chain 90 and bar drive chain 18, in either direction.

Figure 30:
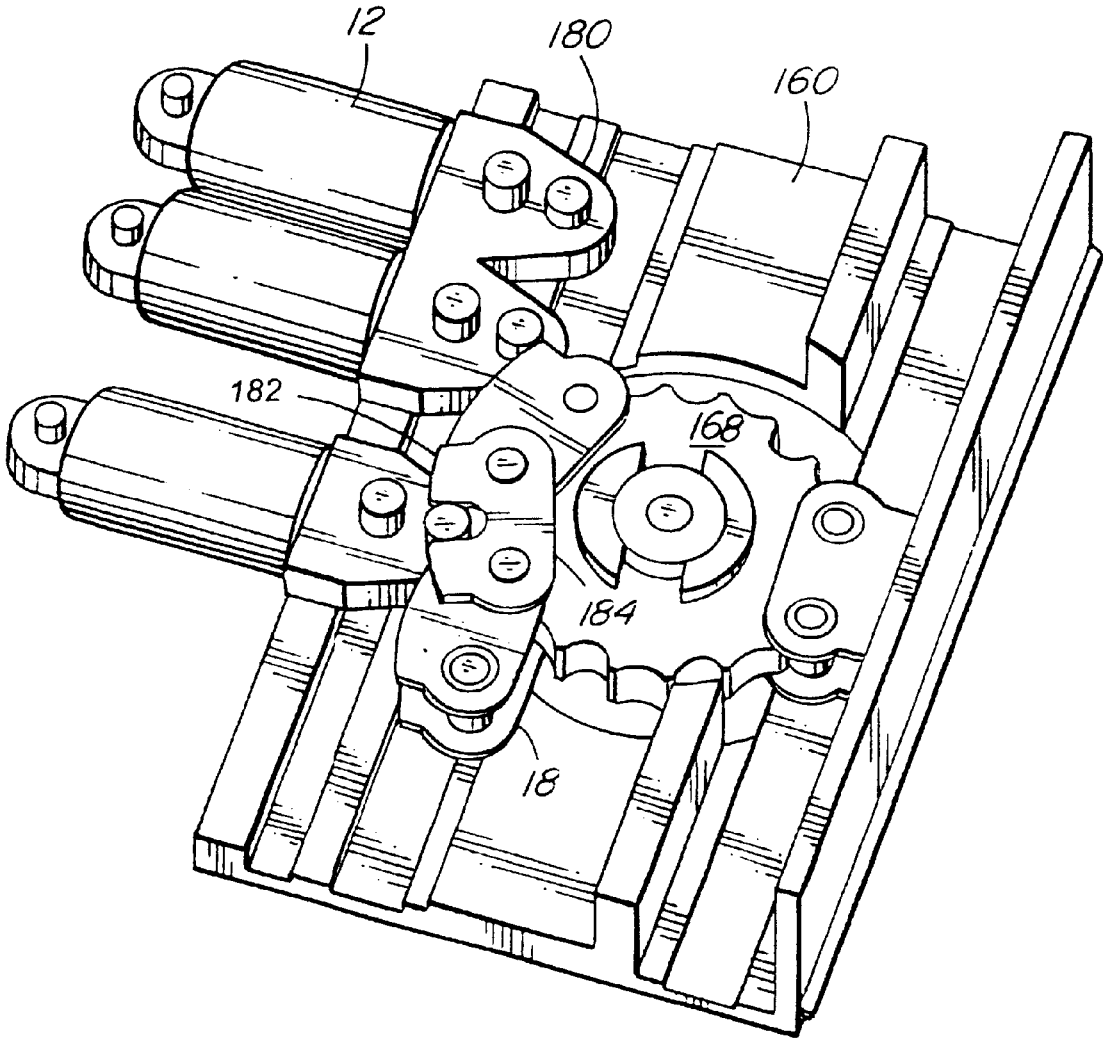
FIG. 30 is an isometric view of an alternative bar transfer mechanism, showing chain links having curved outside edges, wherein some of the chain links include a recess for engaging a pin on a bar end.

FIG. 30 shows an alternative configuration for the links in drive chain 18, in which side plates 182 of each link have a convex arcuate conformation, which provides a smooth exterior curved surface as drive chain 18 moves around drive sprocket 168. In such an embodiment, periodic links may be provided in which side plates 182 are provided with a recess 184 that is adapted to accommodate side pins 180 on the bar ends. In operation, as drive chain 18 travels around drive sprocket 168, with bars 12 stacked above drive sprocket 168, bars 12 will periodically be admitted to engagement with drive chain 18 when a recess 184 becomes available to accommodate a side pin 180.

Figure 21:
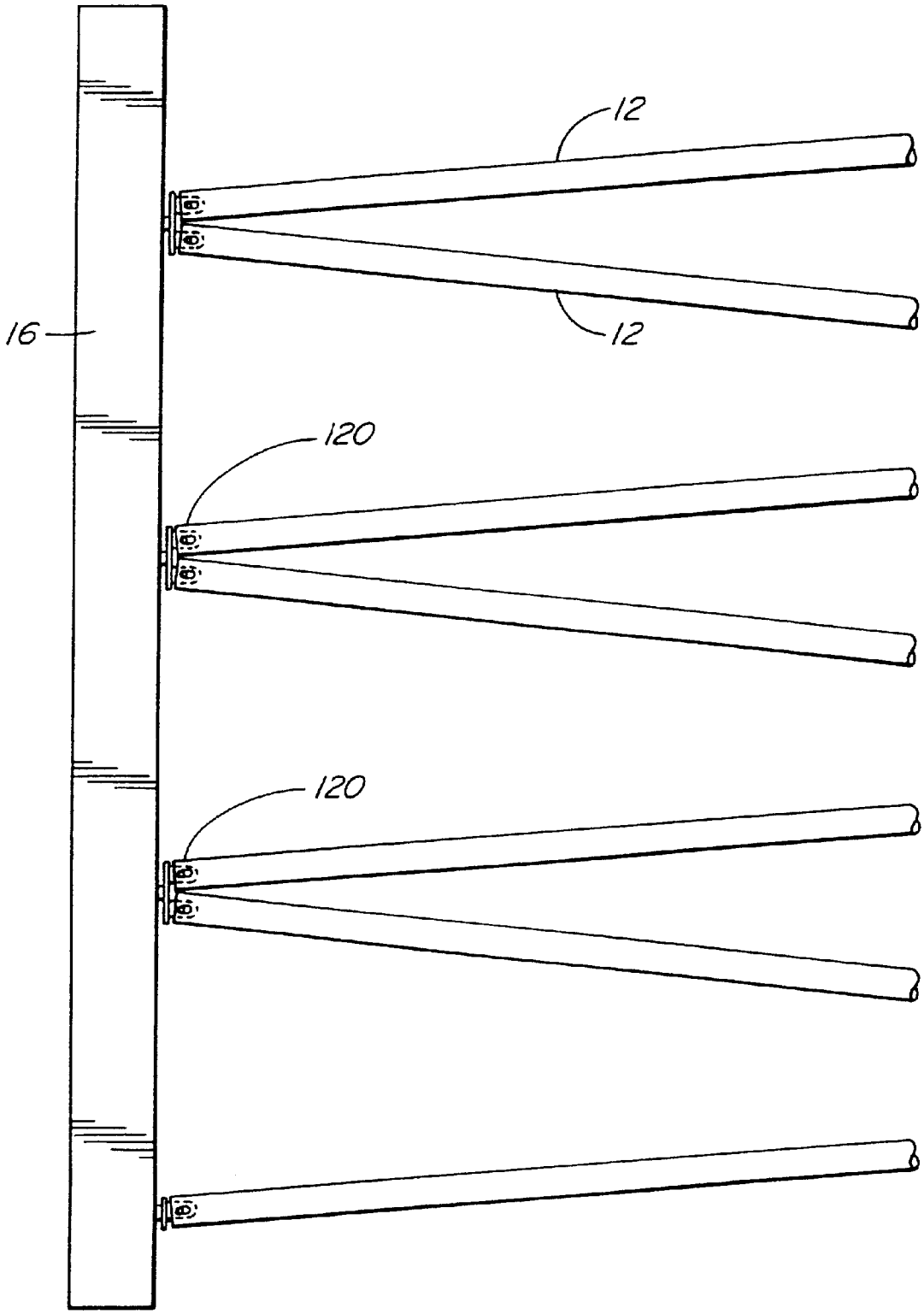
FIG. 21 is a partial front elevational view showing yet a further embodiment of the present invention wherein the bars are angled across the opening.

FIG. 21 shows a security bar assembly wherein the ends of the bars 12 are connected together with a pivotal sliding bar attachment 120 that can have a single pin assembly for connecting to a chain link 38 as shown in FIG. 4, or a multiple connection as shown in FIG. 6. This permits the bars 12 to be zig-zagged across the opening.

Figure 22:
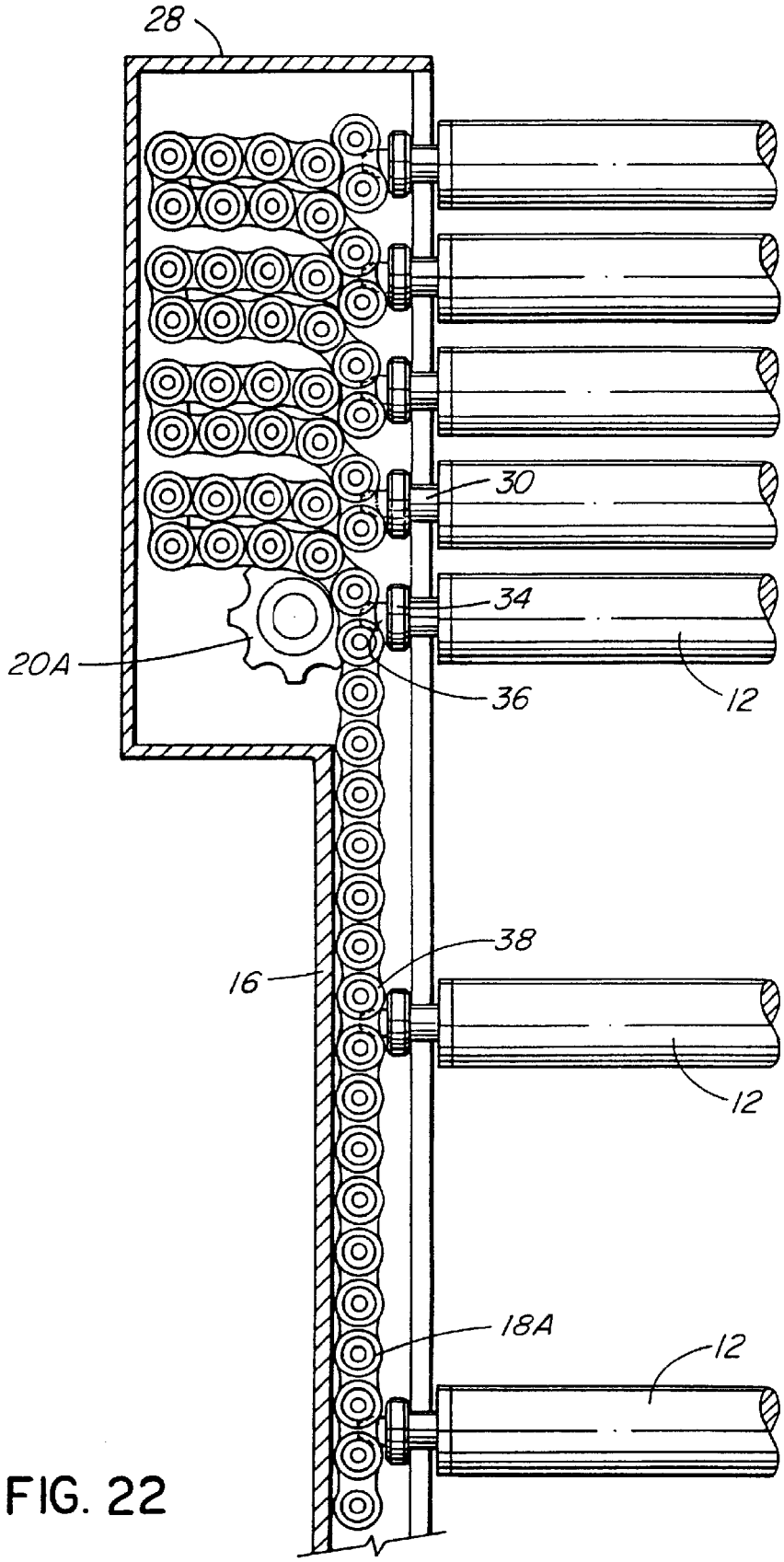
FIG. 22 is a detailed sectional front view showing a drive chain which is not endless and stores the spare chain links between rods above the opening.
Figure 23:
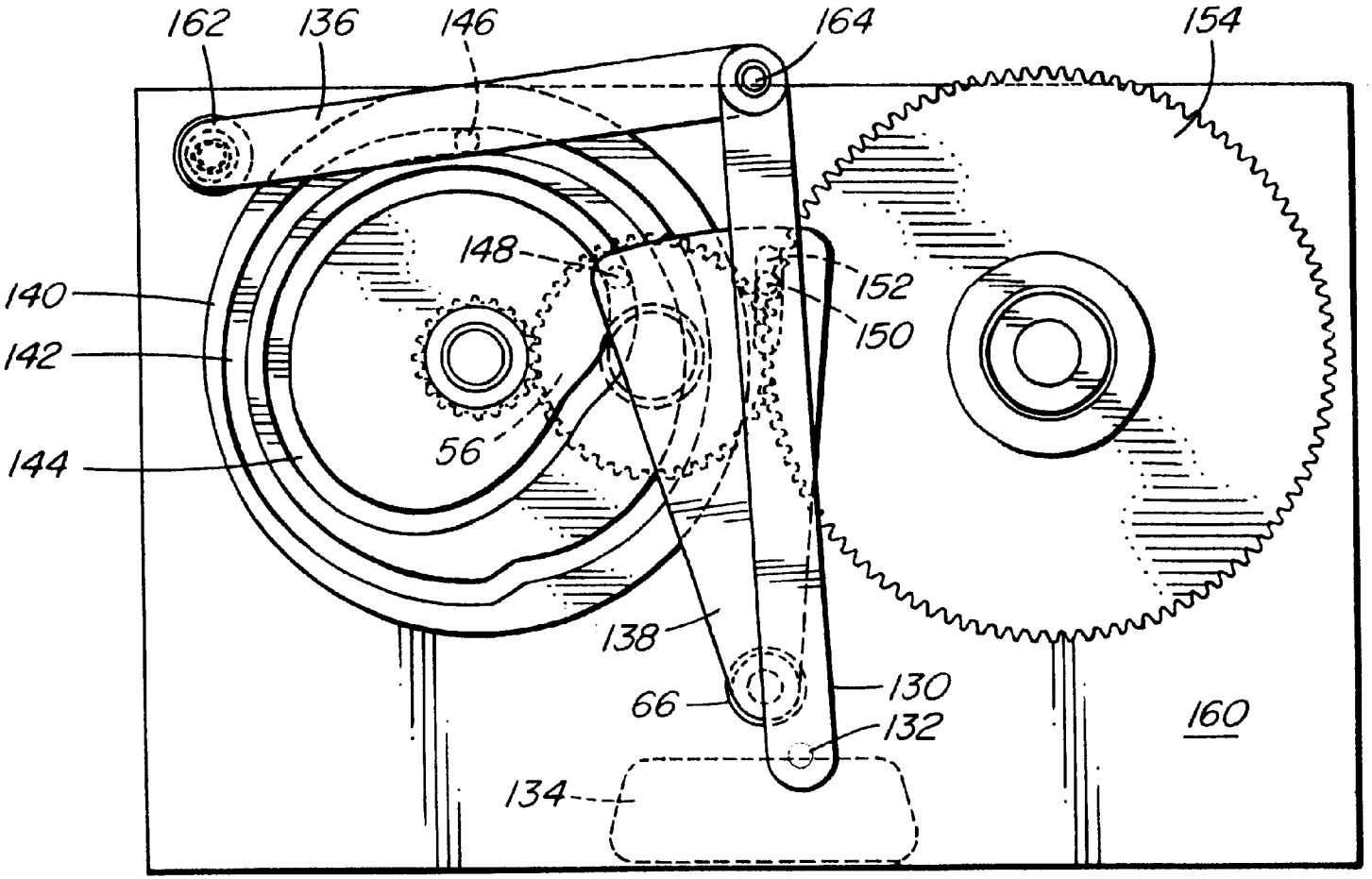
FIG. 23 is a plan view showing a bar transfer mechanism for transferring bars from a drive chain to a storage drive chain.

Whereas the drive chains 18 shown in the other Figures have been shown rotating about first sprocket 20 second sprocket 22 in FIG. 22 there is shown a drive chain 18A which is not endless. A single drive sprocket 20A is positioned at the top of the channel 16 and the drive chain 18A has the end pieces 34 of the bar permanently attached to chain links 38 spaced a predetermined number of links apart. The sprocket 20A is a truncated sprocket so the teeth do not interfere with the end pieces 36 of the bars 12. When the bars 12 are moved up into the storage area 28 the intermediate chain links of the drive chain 18A fold up as shown in the Figure, so the bars 12 are stored as close together as possible. The sprocket 20A pulls the drive chain 18A down feeding the bars 12 across the opening and provided the spacing between the bars 12.

The security bar assembly may be provided with a cloth covering. The cloth covering may be retractable, for example, by being rolled on a spring-actuated shaft, with the ends of the covering adapted to connect to the distal portion of the security bar assembly, for example by hooks. Alternatively, the cloth may be provided in or around the bars 12. For example, bars 12 may be threaded through pockets in the cloth, so that the cloth provides a screen that does not allow one to look through the security bar assembly.

Various changes may be made to the embodiments shown herein without departing from the scope of the present invention which is limited only by the following claims.

We claim:

1. A security bar assembly for an opening comprising:

a plurality of security bars driven by a bar drive chain and a storage drive chain; and a transfer mechanism comprising a transfer arm for moving bars between the bar drive chain and the storage drive chain.

2. The security bar assembly of claim 1 wherein the transfer mechanism further comprises a transfer arm pin provided on the transfer arm to engage a bar end to transfer the bar end from the bar drive chain to the storage drive chain.

3. The security bar assembly of claim 1 wherein the transfer mechanism further comprises a cam wheel operably linked to the transfer arm to actuate the transfer arm.

4. The security bar assembly of claim 3 wherein the transfer mechanism further comprises a lever arm and a lifting arm, wherein the lever arm and the lifting arm are driven by engagement with the cam wheel, and wherein the transfer arm is operably connected to the lever arm and the lifting arm.

5. The security bar assembly of claim 4 wherein the transfer mechanism further comprises:

a lever arm pin provided on the lever arm and accommodated in a lever arm groove of the cam wheel;

a lifting arm pin provided on the lifting arm and accommodated in a lifting arm groove of the cam wheel; and an actuating pin provided on the transfer arm and accommodated in a lifting arm groove on the lifting arm;

wherein, the rotation of the cam wheel moves the lever arm, the lifting arm and the transfer arm.

6. The security bar assembly of claim 5 wherein:

the lever arm may be pivotably connected to a back plate and pivotably connected to the transfer arm; and the lifting arm may be pivotably connected to the back plate.

7. The security bar assembly of claim 3, wherein the transfer mechanism is operably connected to the bar drive chain and storage drive chain, so that the transfer mechanism is driven with the bar drive chain and storage drive chain.

8. The security bar assembly of claim 7 wherein the transfer mechanism further comprises:

a drive wheel gear to drive the cam wheel; and a transfer gear to drive the drive wheel gear.

9. The security bar assembly of claim 8 wherein:

the cam wheel is adapted to drive the storage drive chain; and the drive wheel gear is adapted to drive the bar drive chain.

10. The security bar assembly of claim 1, wherein the transfer arm is provided with a transfer arm pin and the security bars are provide with a feed slot for engaging the transfer arm pin.

11. A security bar assembly for an opening comprising:

a plurality of security bars driven by a bar drive chain; and a transfer mechanism comprising side plates on the bar drive chain, wherein the side plates are adapted to periodically engage a security bar.

12. The security bar assembly of claim 11 wherein the bar drive chain is comprised of connected chain links, and the side plates form the connection between the chain links.

13. The security bar assembly of claim 11, wherein the side plates have an external convex arcuate conformation for engaging a side pin on the security bars, and wherein periodic side plates are provided with a recess adapted to accommodate a side pin on a security bar to admit the security bar to engagement with the drive chain.

14. A security bar assembly for an opening comprising:

a plurality of security bars adapted to operably engage a plurality of drive chains; and a transfer mechanism comprising a transfer arm for moving bars between a plurality of drive chains.

15. The security bar assembly of claim 14 wherein the transfer mechanism further comprises a transfer arm pin provided on the transfer arm to engage a bar end to transfer the bar end between the plurality of drive chains.

16. The security bar assembly of claim 14 wherein the transfer mechanism further comprises a cam wheel operably linked to the transfer arm to actuate the transfer arm.

17. The security bar assembly of claim 16 wherein the transfer mechanism further comprises a lever arm and a lifting arm, wherein the lever arm and the lifting arm are driven by engagement with the cam wheel, and wherein the transfer arm is operably connected to the lever arm and the lifting arm.

18. The security bar assembly of claim 17 wherein the transfer mechanism further comprises:

a lever arm pin provided on the lever arm and accommodated in an lever arm groove e of the cam wheel;

a lifting arm pin provided on the lifting arm and accommodated in an lifting arm groove of the cam wheel; and an actuating arm pin provided on the transfer arm and accommodated in a lifting arm groove on the lifting arm wherein, the rotation of the cam wheel moves the lever arm, the lifting arm and the transfer arm.

19. The security bar assembly of claim 18 where:

the lever arm may be pivotably connected to a back plate and pivotably connected to the transfer arm; and the lifting arm may be pivotably connected to the back plate.

20. The security bar assembly of claim 16, wherein the transfer mechanism is operably connected to the bar drive chain and storage drive chain, so that the transfer mechanism is driven with the bar drive chain and storage drive chain.

21. The security bar assembly of claim 20 wherein the transfer mechanism further comprises:

a drive wheel gear to drive the cam wheel; and a transfer gear to drive the drive wheel gear.

22. The security bar assembly of claim 21 wherein the cam wheel and drive wheel gear are adapted to drive the plurality of drive chains.

23. The security bar assembly of claim 14, wherein the transfer arm is provided with a transfer arm pin and the security bars are provided with a feed slot for engaging the transfer arm pin.

* * * * *